US007014346B2

(12) United States Patent
Goller et al.

(10) Patent No.: US 7,014,346 B2
(45) **Date of Patent: *Mar. 21, 2006**

(54) LIGHT SHIELD MOUNTING FOR AUTOMOTIVE HEADLAMP

(75) Inventors: Jon P. Goller, Heltonville, IN (US); James W. Acker, Brownstown, IN (US)

(73) Assignee: Valeo Sylvania L.L.C., Seymour, IN (US)

( * ) Notice: Subject to any disclaimer, the term of this patent is extended or adjusted under 35 U.S.C. 154(b) by 70 days.

This patent is subject to a terminal disclaimer.

(21) Appl. No.: 10/795,734

(22) Filed: Mar. 8, 2004

(65) Prior Publication Data

US 2005/0195610 A1 Sep. 8, 2005

(51) Int. Cl.
*B60Q 1/04* (2006.01)

(52) U.S. Cl. ..... 362/539; 362/303

(58) Field of Classification Search ..... 362/539, 362/540, 396, 343, 304, 305, 303; 313/113, 313/117

See application file for complete search history.

(56) References Cited

U.S. PATENT DOCUMENTS 1,661,260 A * 3/1928 Muller ..... 362/295
5,067,054 A * 11/1991 Oshio et al. ..... 362/510
6,012,830 A * 1/2000 Fraizer ..... 362/539
6,132,068 A * 10/2000 Katsumata ..... 362/351
6,203,177 B1 * 3/2001 Watanabe et al. ..... 362/351
6,238,072 B1 * 5/2001 Eto ..... 362/539
6,267,488 B1 * 7/2001 Muegge et al. ..... 362/509
6,375,341 B1 * 4/2002 Denley ..... 362/539
6,450,670 B1 * 9/2002 Strauss et al. ..... 362/294
6,786,624 B1 * 9/2004 Poorman ..... 362/539
2002/0167819 A1 * 11/2002 Yamaguchi et al. ..... 362/547

* cited by examiner

*Primary Examiner*—Ali Alavi
*Assistant Examiner*—Hargobind S. Sawhney
(74) *Attorney, Agent, or Firm*—William E. Meyer

(57) ABSTRACT

A lamp unit has a reflector (62) having a reflector surface (64) with an inverted U-shaped aperture (66) formed therein and extending through said reflector to an opposite surface (68). The inverted U-shaped aperture thereby has a bight (72) uppermost with a pair of channels (74, 76) depending therefrom. A light-shield has a cup-shaped member having an arm (52) projecting therefrom. The arm (52) has a distal end (50) formed to provide a pair of spring-loaded nibs (54, 56) for engaging and penetrating the channels (74, 76) of the inverted U-shaped aperture (66) and surrounding and grasping the bar (78) formed between the channels.

3 Claims, 4 Drawing Sheets

LIGHT SHIELD MOUNTING FOR AUTOMOTIVE HEADLAMP

TECHNICAL FIELD

This invention relates to lamp units and more particularly to automotive headlamps. Still more particularly it relates to a reflector and shield for an automotive headlamp unit.

BACKGROUND ART

Automotive headlamps employ small light sources arranged in a reflector. It is common practice to cover the forwardmost facing part of the light source with a cup-shaped shield. Mounting the shield is a continuing problem usually solved by having an arm on the shield having a distal end that is fixed to the reflector at a remote location, usually by a screw or by a pressed-in fit, which involved a spring-like end of the distal end being pushed into an aperture. Use of the screw introduces an extra part raising the cost while the pressed-in feature often allows the shield to fall out if it is not properly engaged. A still further method disclosed in Attorney Docket No. 02-4-180, filed Feb. 14, 2004, involved the use of nibs formed on the terminal end of a distal portion, which nibs were deformed after insertion in an appropriate aperture. This procedure works well although the shield cannot be removed without breaking the nibs, thus making removal and reuse impossible.

DISCLOSURE OF INVENTION

It is, therefore, an object of the invention to obviate the disadvantages of the prior art.

It is another object of the invention to enhance light shields in automotive headlamps.

These objects are accomplished, in one aspect of the invention, by the provision of a lamp unit comprising a reflector having a reflector surface with an inverted U-shaped aperture formed therein and extending through said reflector to an opposite surface. The inverted U-shaped aperture has the bight uppermost with a pair of channels depending therefrom; and defining a bar therebetween. A light-shield has a cup-shaped member having an arm projecting therefrom, the arm having a distal end formed to provide a pair of spring-loaded nibs for engaging and penetrating the channels of the inverted U-shaped aperture and encompassing the bar to fix the position of the light-shield relative to said reflector.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
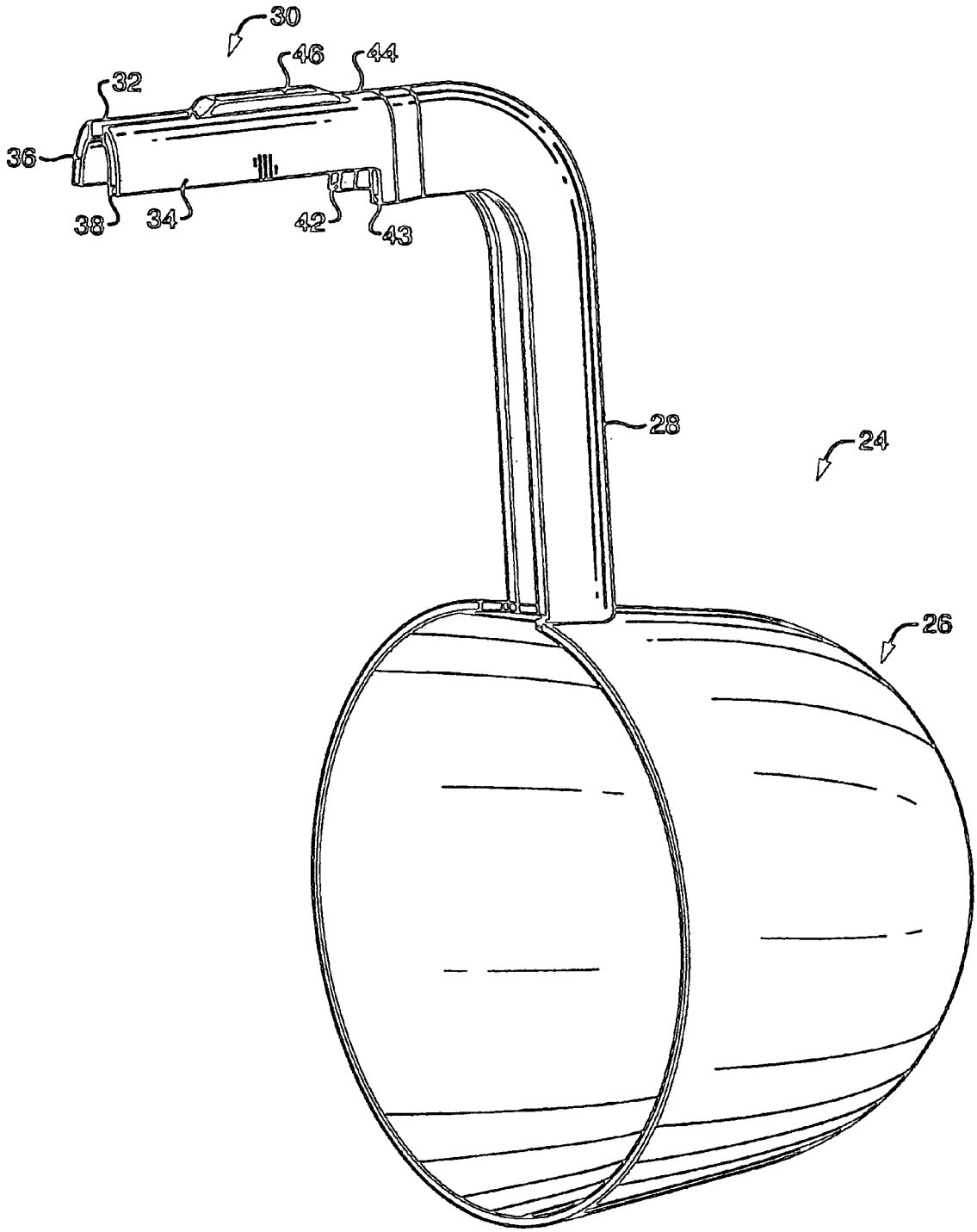
FIG. 1 PRIOR ART
FIG. 1 is a perspective view of a prior art.

Referring now to the drawings with greater particularity, there is shown in FIG. 1 a prior art light-shield 24 having a cup-shaped member 26 with an arm 28 projecting therefrom. The arm 28 has a distal end 30 formed to provide nibs 32, 34 having ends 36, 38. After insertion through an appropriate aperture the nibs 32, 34 were deformed by bending either inwardly or outwardly to provide permanent securement.

Figure 2:
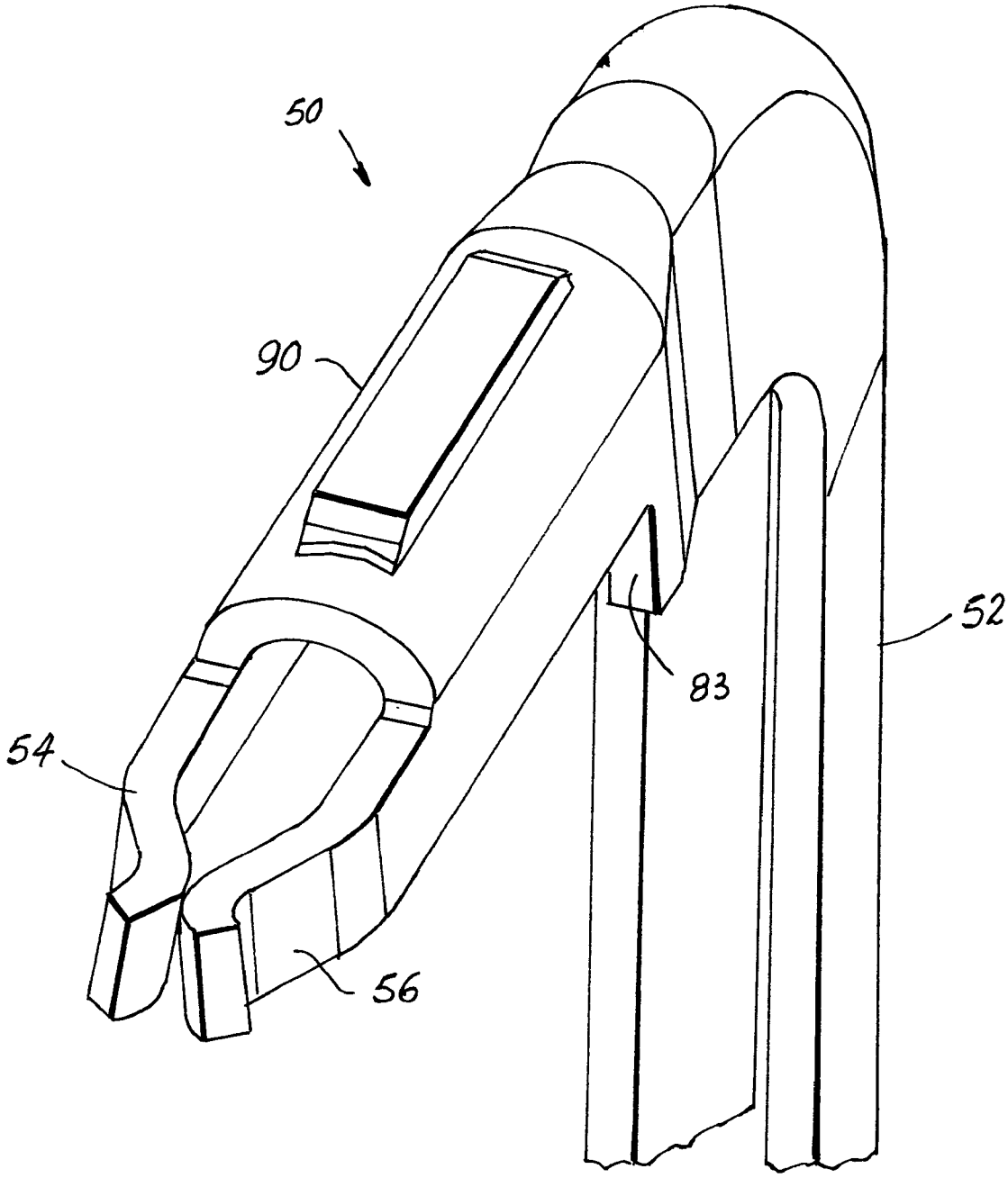
FIG. 2 is a perspective view of a of the distal end of a shield arm.
Figure 3:
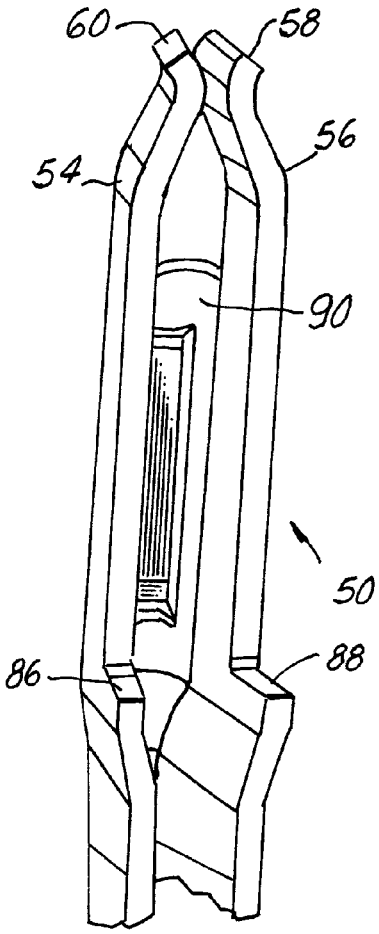
FIG. 3 is a perspective view of the distal end of the shield arm from different direction.
Figure 4:
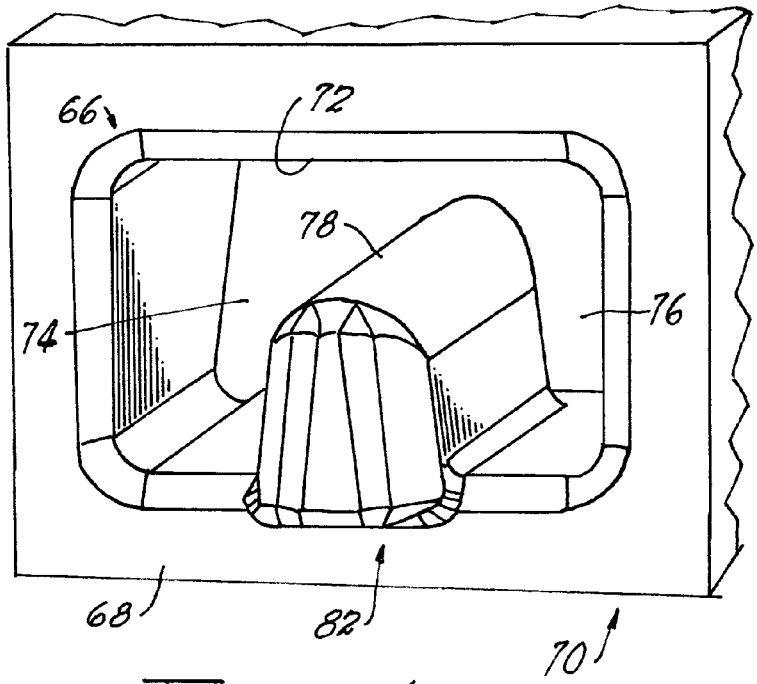
FIG. 4 is a perspective view of the rear or exit area of the aperture formed in the reflector.
Figure 5:
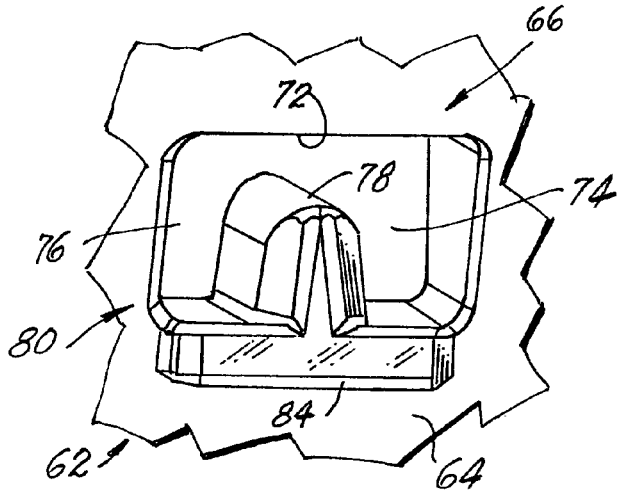
FIG. 5 is a perspective view of the entrance area of the aperture.

The instant invention is shown in FIGS. 2–6. Referring now more particularly to FIG. 2, there is shown the distal end 50 of a shield arm 52, the cup-shaped portion being omitted for clarity. The distal end 50 is provided with spring-loaded nibs 54, 56 having ends 58, 60 that are directed away from one another.

A reflector 62 (shown partially in FIG. 5) has a reflector surface 64 with an inverted U-shaped aperture 66 formed therein and extending through the reflector to an opposite surface 68. To provide an adequate length for nibs 54, 56, a housing 70 is formed with surface 68.

Figure 6:
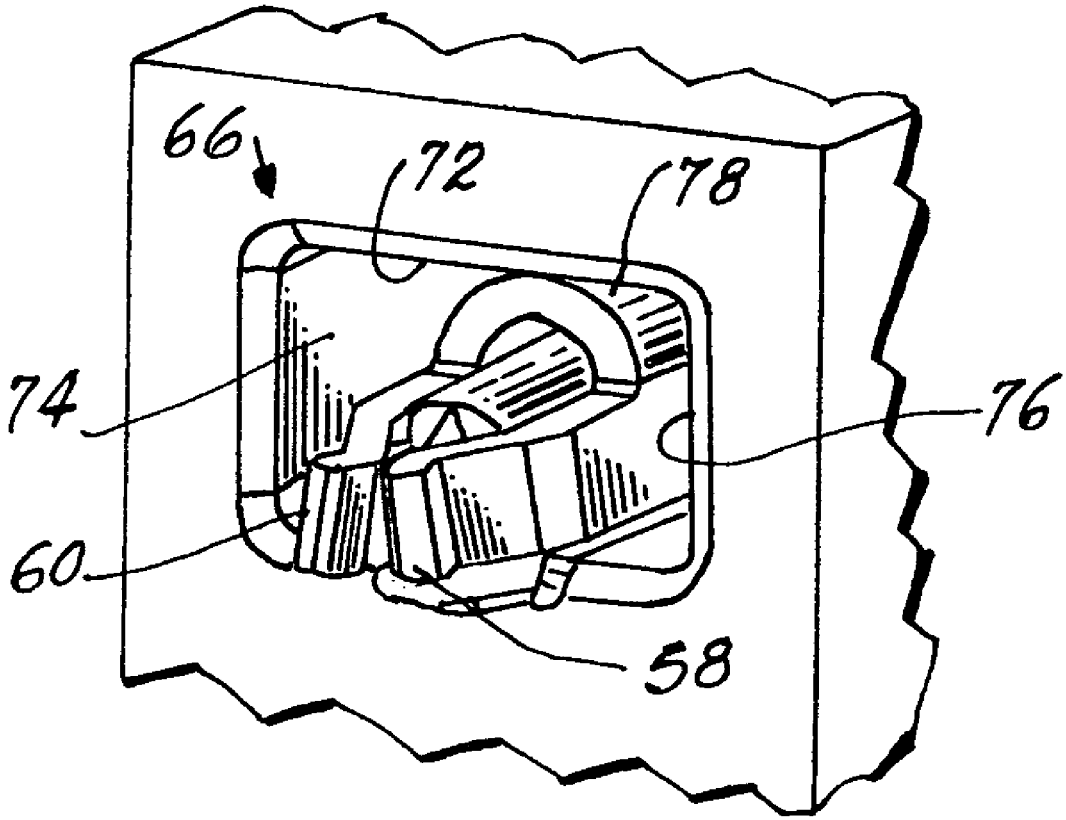
FIG. 6 is a perspective view of the exit area of the aperture with the distal portion of the shield arm in position.

The inverted U-shaped aperture 66 has a bight 72 uppermost and channels 74, 76 depending therefrom to receive the nibs 54, 56, as shown in FIG. 6. A bar 78 exists in the center of the aperture 66. Aperture 66 has an entrance side 80 and an exit side 82 and the entrance side 80 is provided with a stop 84 that limits the penetration of nibs 54 and 56 into the aperture 66. The stop 84 cooperates with mating stop edges 86, 88 formed on nibs 54, 56.

A transverse web 90 connects the nibs 54, 56 for a part of their length and is provided with a tensioning spring member 92. When the nibs 54, 56 are inserted into the channels 74, 76, the tensioning spring member 92 exerts downward pressure against the bight 72 and the bar 78 formed between the channels 74, 76, and the spring-loaded nibs 54, 56, close together surrounding the bar 78, thereby accurately positioning the light-shield with respect to the reflector 62.

In a preferred embodiment of the invention the entrance end 100 of bar 78 is narrower than the exit end 102 to ease the insertion of the nibs 54, 56.

Also, in a preferred embodiment of the invention, the reflector material is unsaturated polyester and the light-shield material is 1008–1010 C.R.S.

This structure greatly enhances the operation of lamp units. The cooperation between the stop 84 and the stop-edges 86, 88, the fit between the nibs 54, 56 and the channels 74, 76, and the tension provided by the tensioning spring member 92, together with the spring tension provided by the nibs 54, 56, guaranty a proper initial location for the light-shield. Because the nibs are spring-loaded it is possible to remove the entire light shield should the need arise.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A lamp unit comprising:

a reflector having a reflector surface with an inverted U-shaped aperture formed therein and extending through said reflector to an opposite surface, said inverted U-shaped aperture thereby having a pair of channels depending therefrom; and defining a bar therebetween; and a light-shield comprising a cup-shaped member having an arm projecting therefrom, said arm having a distal end formed to provide a pair of spring-loaded nibs for engaging and penetrating said channels of said inverted U-shaped aperture and encompassing said bar to fix the position of said light-shield relative to said reflector.

2. The lamp unit of claim 1 wherein said inverted U-shaped aperture has an entrance side and an exit side and said entrance side is provided with a stop that cooperates with mating stop edges formed in said nibs and determines the degree of penetration of said nibs into said channels of said inverted U-shaped aperture.

3. The lamp unit of claim 1 wherein said nibs have a transverse bar connecting them for part of their length and said transverse bar is provided with a tensioning spring.

* * * * *